US010584009B1

(12) United States Patent
Wurmfeld et al.

(10) Patent No.: US 10,584,009 B1
(45) **Date of Patent: *Mar. 10, 2020**

(54) SHEET ORIENTING APPARATUS USING BALL DRIVE

(71) Applicant: Capital One Services, LLC, McLean, VA (US)

(72) Inventors: David Wurmfeld, Falls Church, VA (US); Kevin Osborn, Newton Highlands, MA (US)

(73) Assignee: Capital One Services, LLC, McLean, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/530,499

(22) Filed: Aug. 2, 2019

(51) Int. Cl.

| | |
|---|---|
| ***B65H 9/00*** | (2006.01) |
| ***B65H 5/06*** | (2006.01) |
| ***G07F 19/00*** | (2006.01) |
| ***B65H 9/20*** | (2006.01) |
| ***G07D 11/13*** | (2019.01) |
| ***B65H 7/08*** | (2006.01) |
| ***B65H 7/14*** | (2006.01) |
| ***B65H 7/20*** | (2006.01) |

(52) U.S. Cl.
CPC ..... *B65H 9/002* (2013.01); *B65H 5/068* (2013.01); *B65H 7/08* (2013.01); *B65H 7/14* (2013.01); *B65H 7/20* (2013.01); *B65H 9/20* (2013.01); *G07D 11/13* (2019.01); *G07F 19/203* (2013.01); *B65H 2301/331* (2013.01); *B65H 2301/34* (2013.01); *B65H 2404/54* (2013.01); *B65H 2404/696* (2013.01); *B65H 2557/2644* (2013.01)

(58) Field of Classification Search
CPC ..... B65H 5/06; B65H 5/062; B65H 5/068; B65H 7/00; B65H 7/02; B65H 7/08; B65H 7/14; B65H 7/20; B65H 9/00; B65H 9/002; B65H 9/166; B65H 9/20; B65H 2301/331; B65H 2301/34; B65H 2404/54; B65H 2404/696; B65H 2557/2644
See application file for complete search history.

(56) References Cited

U.S. PATENT DOCUMENTS

| | | | | |
|---|---|---|---|---|
| 3,861,673 A | | 1/1975 | Ticknor | |
| 4,909,500 A | * | 3/1990 | Grutzmacher | B65H 3/10 271/112 |
| 5,090,683 A | * | 2/1992 | Kamath | B65H 5/34 271/184 |
| 5,435,543 A | * | 7/1995 | Lehmann | B65H 7/02 226/100 |
| 6,059,284 A | * | 5/2000 | Wolf | B65H 5/062 271/227 |

(Continued)

*Primary Examiner* — Prasad V Gokhale
(74) *Attorney, Agent, or Firm* — Finnegan, Henderson, Farabow, Garrett & Dunner, LLP

(57) ABSTRACT

An ATM includes a sheet driving system with a sheet path along which sheets travel, and sheet sensors and sheet drive mechanisms adjacent the sheet path. One sheet drive mechanism is disposed apart from another sheet drive mechanism in a direction relative to the sheet path, and each sheet drive mechanism is selectively operative to change relative speed and direction of movement of disposed areas of a sheet as the sheet travels adjacent to the sheet drive mechanisms along the sheet path. A control system is responsive to sensing a sheet with a sensor to selectively actuate a sheet drive mechanism to change the position of the sheet relative to the sheet path.

18 Claims, 4 Drawing Sheets

(56) References Cited

U.S. PATENT DOCUMENTS

| | | | | |
|---|---|---|---|---|
| 6,682,068 | B1 | 1/2004 | Haney et al. | |
| 9,776,819 | B2 * | 10/2017 | Yamane | B65H 9/002 |
| 2002/0145249 | A1 * | 10/2002 | Acquaviva | B65H 7/08 271/228 |
| 2011/0156341 | A1 * | 6/2011 | Fujita | B65H 5/062 271/10.11 |
| 2016/0101958 | A1 * | 4/2016 | Park | B65H 9/002 271/234 |

* cited by examiner

SHEET ORIENTING APPARATUS USING BALL DRIVE

TECHNICAL FIELD

The disclosed embodiments generally relate to a sheet driving system and method and, more particularly, a method and apparatus for orienting sheets using a ball drive.

BACKGROUND

In machines that receive and dispense sheets of material, such as automated teller machines (ATM) that receive and dispense cash, checks, and other financial documents, accurate registration and alignment of the sheets, which are generally image receiving substrates, is needed to avoid problems such as paper jams, misidentification of image information on the sheets, improper dispensation of the number or type of new or recycled sheets, and damage to the sheets being handled by the machine. Existing machines may attempt proper alignment and registration of sheets being introduced into the machine by providing guide channels at a point of entry and rollers that pull each sheet into the machine and attempt to align an edge of each sheet along one or more of the guide channels. Errors in the alignment and registration of sheets may occur when sheets, such as cash, are damaged, or include creases, bends, torn edges, or other defects, particularly when the machine recycles and dispenses sheets that have been received. The large variation in sizes, rigidity, and quality of the different types of sheets that may be received and dispensed by the machines may also create problems when trying to construct the machines with universally acceptable guide channels or other existing means for aligning and registering sheets.

The term "sheet" as used in this disclosure is intended to cover any type of generally planar member or substrate being transported, such as a paper sheet, cash of various denominations, a plate of flexible or rigid material, cardboard, plastic, or the like, either individually or in overlying stacks.

The present disclosure is directed to addressing one or more of the problems set forth above and/or other problems associated with orienting and properly registering or aligning sheets that are handled by different machines.

SUMMARY

In one aspect, the present disclosure is directed to an Automated Teller Machine (ATM) that includes a sheet driving system. The sheet driving system may include a sheet path, wherein sheets travel in a direction parallel to a first direction along the sheet path, a first sheet sensor and a second sheet sensor adjacent the sheet path, wherein the first and second sheet sensors are disposed apart from each other in a transverse direction relative to the first direction, and a first sheet drive mechanism and a second sheet drive mechanism adjacent the sheet path, wherein the second sheet drive mechanism is disposed apart from the first sheet drive mechanism in a transverse direction relative to the first direction, and wherein each sheet drive mechanism is selectively operative to change relative speed and direction of movement of disposed areas of a sheet adjacent to the sheet drive mechanisms as the sheet travels adjacent to the sheet drive mechanisms along the sheet path. The ATM may also include a control system in operative connection with the first and second sheet sensors and the first and second sheet drive mechanisms, wherein the control system is operative responsive to sensing a sheet with at least one of the first or second sensors to selectively actuate at least one of the first or second sheet drive mechanisms to change the position of the sheet relative to the sheet path.

In another aspect, the present disclosure is directed to an apparatus for driving one or more sheets. The apparatus may include a sheet path, wherein sheets travel in a direction parallel to a first direction along the sheet path, a first sheet sensor and a second sheet sensor adjacent the sheet path, wherein the first and second sheet sensors are disposed apart from each other in a transverse direction relative to the first direction, and a first sheet drive mechanism and a second sheet drive mechanism adjacent the sheet path, wherein the second sheet drive mechanism is disposed apart from the first sheet drive mechanism in a transverse direction relative to the first direction, and wherein each sheet drive mechanism is selectively operative to change relative speed and direction of movement of disposed areas of a sheet adjacent to the sheet drive mechanisms as the sheet travels adjacent to the sheet drive mechanisms along the sheet path. The apparatus may also include a control system in operative connection with the first and second sheet sensors and the first and second sheet drive mechanisms, wherein the control system is operative responsive to sensing a sheet with at least one of the first or second sensors to selectively actuate at least one of the first or second sheet drive mechanisms to change the position of the sheet relative to the sheet path.

In yet another aspect, the present disclosure is directed to a machine control system for a machine, wherein the machine includes a sheet path. Sheets travel through a portion of the machine in a direction parallel to a first direction along the sheet path. The machine may also include a first sheet sensor and a second sheet sensor adjacent the sheet path, wherein the first and second sheet sensors are disposed apart from each other in a transverse direction relative to the first direction, and a first sheet drive mechanism and a second sheet drive mechanism adjacent the sheet path, wherein the second sheet drive mechanism is disposed apart from the first sheet drive mechanism in a transverse direction relative to the first direction, and wherein each sheet drive mechanism is selectively operative to change relative speed and direction of movement of disposed areas of a sheet adjacent to the sheet drive mechanisms as the sheet travels adjacent to the sheet drive mechanisms in the sheet path. Each of the sheet drive mechanisms may include two motors, two drive disks, a fixture, and a ball rotatably supported in the fixture. Each of the drive disks may be rotatably driven by one of the motors, and the ball may be rotatably supported in the fixture with portions of the outer peripheral surface of the ball being exposed through openings in the fixture and frictionally engaged with the drive disks. The machine control system may be configured to receive signals from the first and second sheet sensors indicative of a skew in the orientation of the sheet relative to the first direction, and send command signals to the first and second sheet drive mechanisms to selectively actuate the first and second sheet drive mechanisms to change the position of the sheet relative to the sheet path.

It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute a part of this specification, illustrate disclosed embodiments and, together with the description, serve to explain the disclosed embodiments. In the drawings.

DETAILED DESCRIPTION

The method and apparatus according to the present disclosure address the disadvantages of the prior art by ensuring accurate positioning and orientation of each sheet being processed through a machine such as an automated teller machine (ATM) or other machine that benefits from proper orientation of each sheet when retrieving information from each sheet, or when performing other operations such as stacking of sheets to be recycled and dispensed from the machine.

Figure 1:
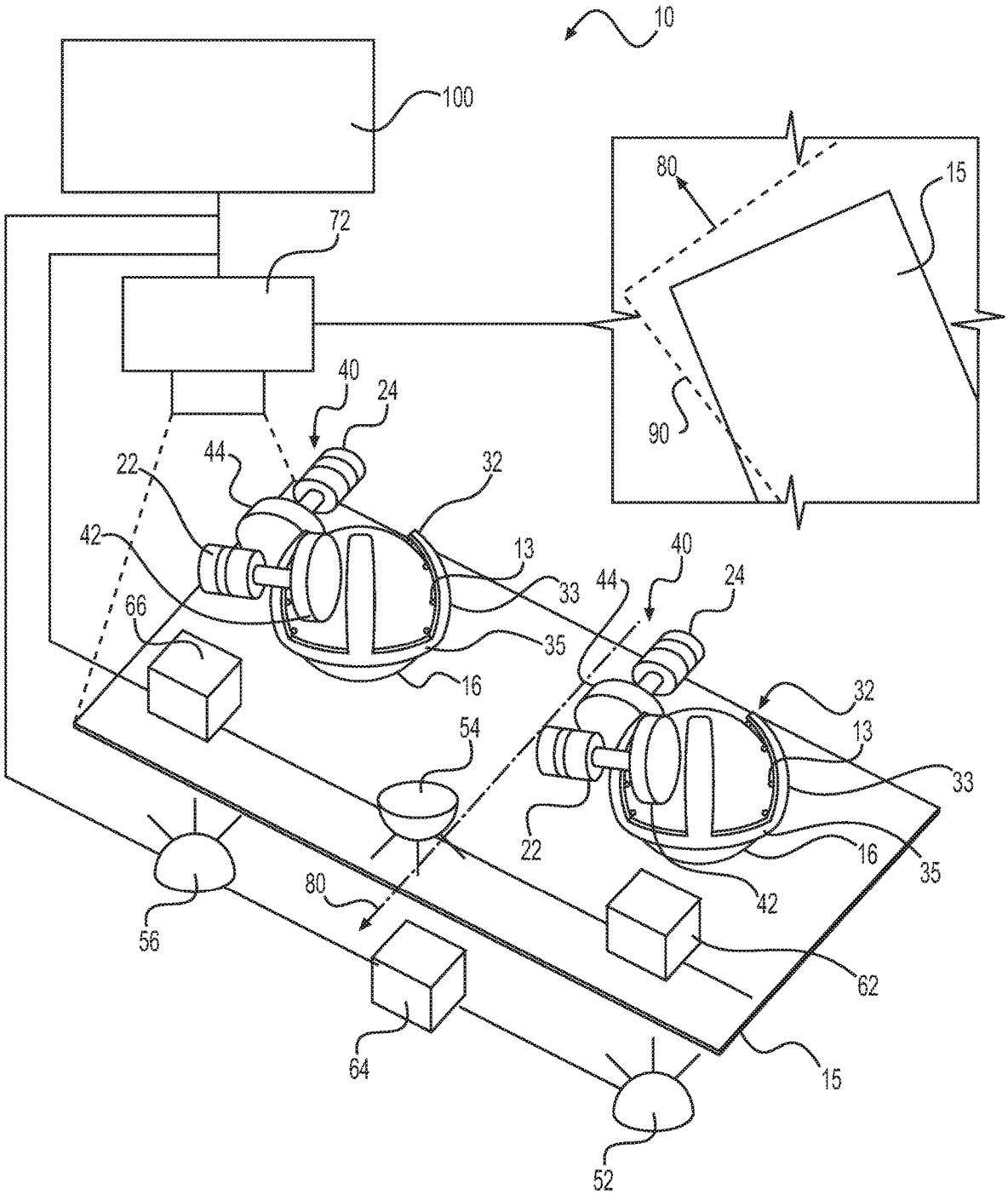
FIG. 1 is a schematic illustration of an exemplary sheet drive system.

FIG. 1 shows an exemplary embodiment of a sheet driving system 10 according to this disclosure, configured for driving, orienting, and registering a sheet 15 in lateral and longitudinal directions relative to a sheet path 80 along which sheet 15 travels in a machine such as an ATM. A sheet driving system according to this disclosure is configured to move a sheet in any direction within the plane of the sheet path along which the sheet is traveling, including simply driving the entire sheet to travel in a "Y" direction aligned with the sheet path, causing the sheet to change orientation as it is moved in the Y direction, such as by rotating the sheet around a "Z" axis perpendicular to the Y and "X" axes, causing at least a portion of the sheet to move in the "X" direction perpendicular to the Y direction of the sheet path, and causing at least a portion of the sheet to move in the plane of the sheet path in a direction that has both X and Y directional components. References to cartesian coordinates such as "X," "Y," and "Z" in this application are for illustration only, and motion can be referenced and controlled by sheet driving system 10 using polar coordinates "r" and "θ" as well. While the cartesian coordinate system is a two-dimensional coordinate system using a rectilinear grid, the polar coordinate system is a two-dimensional coordinate system using a polar grid. The word "orienting" or "orientation" as used throughout this disclosure, refers to movement of a sheet in any or all of the directions discussed above. Various embodiments of sheet driving system 10 may be included in different types of machines that process or handle sheets of material, such as ATMs that process cash, checks, and other financial documents, and payment acceptance machines, such as machines that accept cash for payment for services such as a car wash, or for products, such as a food vending machine.

Figure 2:
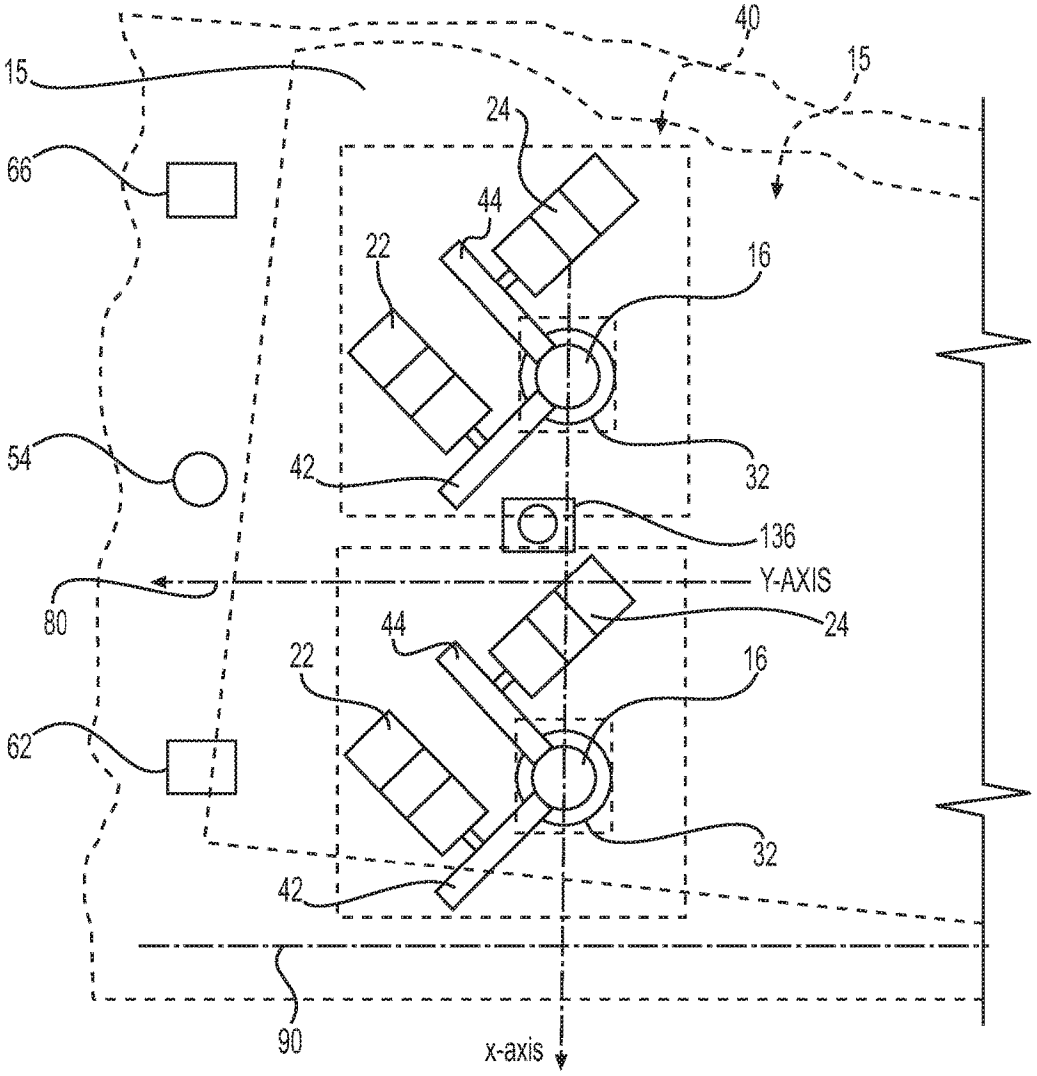
FIG. 2 is a schematic illustration of an embodiment of the sheet drive system of FIG. 1.

As shown in FIGS. 1 and 2, sheet 15 may be selectively driven to travel in a direction parallel to a first direction along a sheet path 80 and to change position or orientation relative to sheet path 80 by one or more independently driven sheet drive mechanisms 40 that may be positioned adjacent sheet path 80 and arranged transversely relative to sheet path 80. Sheet sensors may also be positioned adjacent sheet path 80 and disposed apart from each other in a transverse direction relative to the first direction. A control system or controller 100 may be operatively connected with the sheet sensors and the sheet drive mechanisms.

Control system 100 may be in operative connection with the sheet sensors and sheet drive mechanisms 40 such that the control system is operative responsive to sensing a sheet with at least one of the sensors to selectively actuate at least one of the sheet drive mechanisms. Selective actuation of the sheet drive mechanisms may selectively change relative speed and direction of movement of disposed areas of sheet 15 so as to change a position of sheet 15 relative to sheet path 80. Sheet drive mechanisms 40 may be arranged at different locations adjacent sheet path 80, for example, such that each sheet drive mechanism 40 is configured to contact a sheet at different, spaced positions across the width or length of the sheet. Although two sheet drive mechanisms 40 are shown in FIGS. 1 and 2, alternative embodiments may include only one sheet drive mechanism or more than two sheet drive mechanisms. Each sheet drive mechanism 40 may be selectively operative to change relative speed and direction of movement of disposed areas of sheet 15 adjacent to the sheet drive mechanisms as the sheet travels adjacent to the sheet drive mechanisms along the sheet path.

Each sheet drive mechanism 40 may include a ball 16, which will be referred to herein as a "gripper ball". Gripper ball 16 is rotatably supported in a fixture 32. As shown in the side elevation view of FIG. 4, each gripper ball 16 may contact an upper surface of sheet 15 at a position on an opposite side of sheet 15 from a backer ball 116, caster, or other support member that supports sheet 15 on the opposite side of sheet 15 from the point of contact with gripper ball 16. Sheet 15 is pinched in between each gripper ball 16 and backer ball 116 or other support member. In alternative implementations, sheet 15 may be supported on a flat surface, a series of parallel rollers, or other support members that exert an upward pressure on the opposite side of sheet 15 from gripper balls 16 of sheet drive mechanisms 40, thus creating a nip in between each gripper ball 16 and the corresponding support member. Alternative embodiments may include a support surface along which an air curtain is generated in order to facilitate movement of sheet 15 along sheet path 80 and reorientation of sheet 15 relative to the direction of sheet path 80 if desired.

An advantage of supporting each sheet 15 at omnidirectional rotatable points of contact such as provided by rotatable backer balls 116, rather than an immovable flat surface, is reduced friction against sheet 15 as each gripper ball 16 is selectively actuated to drive and change the position or direction of orientation of sheet 15. The ability to use support members such as backer balls 116 with omnidirectional rotatable points of contact against the bottom surface of sheet 15 rather than an immovable flat support surface may also depend in part on the rigidity or stiffness of sheet 15, the size of sheet 15, and the span between sheet drive mechanisms 40. Gripper ball 16 may include an outer peripheral surface coated with or made from a material such as rubber or another elastomeric material, or provided with a roughened or textured surface to enhance frictional engagement between gripper ball 16 and sheet 15 during driving and positioning of sheet 15.

The characteristics of the outer peripheral surface of gripper ball 16 and the nip created between each gripper ball 16 and a corresponding omnidirectional rotatable support such as backer ball 116, enable gripper ball 16 to move sheet 15 in different directions with a minimal amount of contact pressure. For example, selective actuation of one sheet drive mechanism 40 to cause rotation of a single gripper ball 16 about the Z axis perpendicular to sheet 15 while gripper ball 16 makes contact with the top surface of sheet 15 may be sufficient in some implementations to cause rotation of an entire sheet 15 about the Z axis. Alternative implementations may also include more than two sheet drive mechanisms 40 with gripper balls 16 positioned to come into contact with one or more sheets traveling along sheet path 80. One or more sheet drive mechanisms 40 with gripper balls 16 may be sufficient to drive sheet 15 to travel along sheet path 80, to redirect sheet 15 to a second path different from sheet path 80, and to change the position of sheet 15 if required to deskew or align sheet 15 to a particular orientation.

Each gripper ball 16 may be caused to rotate about any axis through its center and substantially parallel to the plane of sheet 15, within normal machining and assembly tolerances. As shown in the exemplary embodiment of FIGS. 1 and 2, each gripper ball 16 may be driven by two electric motor driven drive disks. A first electric motor 22 may drive a first drive disk 42 that contacts gripper ball 16 in a first location on the outer peripheral surface of gripper ball 16, and a second electric motor 24 may drive a second drive disk 44 that contacts gripper ball 16 in a second location on the outer peripheral surface of gripper ball 16.

Fixture 32 rotatably supporting gripper ball 16 may be configured to include circumferentially spaced openings designed to expose portions of the outer peripheral surface of gripper ball 16 such that the drive disks may drivingly contact gripper ball 16. As shown in FIG. 2, one exemplary implementation includes electric motors 22, 24 rotating drive disks 42, 44 such that the drive disks contact the outer peripheral surface of gripper ball 16 at positions spaced approximately 90 degrees from each other, with each of the points of contact also being oriented at approximately 45 degrees from the direction of sheet path 80. In various exemplary embodiments of this disclosure, drive disks 42, 44 may be constructed as cylindrical or disk-shaped magnets, or may include magnetic material, and gripper ball 16 may include a steel core or other ferritic materials such that a magnetic force will bias each of the drive disks into contact with the gripper ball and ensure continuous contact between the drive disks and each gripper ball 16 during operation, even as the drive disks and gripper ball wear over time.

Controller or control system 100 may include one or more processors configured to receive signals from various inputs, such as sensors operative to detect the presence, size, shape, orientation, and/or edges of sheets, and computer vision devices, and generate command control signals that are transmitted to electric motors 22, 24 of sheet drive mechanisms 40. Control system 100 may be part of a server, client, network infrastructure, mobile computing platform, stationary computing platform, or other computing platform. The one or more processors of control system 100 may be any kind of computational or processing device capable of executing program instructions, codes, binary instructions and the like. The processor may be or include a signal processor, digital processor, embedded processor, microprocessor or any variant such as a co-processor (math co-processor, graphic co-processor, communication co-processor and the like) that may directly or indirectly facilitate execution of program code or program instructions stored thereon. Control system 100 may include control logic and memory that enables machine learning and storage of data to enhance efficiency and effectiveness in recognizing types and characteristics of sheets and implementing control of the number and type of sheet drive mechanisms most suitable for each particular type of sheet.

Fixtures 32 may be movably or fixedly supported on structural members such as shuttles, which may in turn be slidably supported on cross bars or other internal structural members of a machine such as an automated teller machine (ATM). The structural members may extend across one or more sheet paths 80 along which sheets such as cash of various denominations, checks, or other documents are introduced into the machine or dispensed from the machine. In some embodiments, each fixture 32 and gripper ball 16 may be fixed in place relative to a sheet path 80. In other alternative embodiments, a fixture may be configured for movement relative to sheet path 80 and selective positioning at a desired spacing from another fixture that depends at least in part on the size of one or more sheets 15 being driven and positioned by sheet drive mechanisms 40. The positioning of each of fixtures 32 may also depend in part on other parameters such as the thickness of each sheet, and the rigidity or stiffness of each sheet.

A photodetector or digital camera 72 positioned near an entrance to sheet path 80 may employ computer vision technology to detect a leading edge of sheet 15 as sheet 15 is fed into a machine such as an ATM. Photodetector 72 may also be configured to produce a signal indicative of the overall size and/or shape of each sheet 15, and may be supplemented with additional detection devices such as infrared sensors, proximity sensors, and other sensing devices suitable for determining the thickness, rigidity or other characteristics of sheet 15. In some embodiments, the detected characteristics of each sheet 15 may be processed by control system 100 and used in determining the number of sheet drive mechanisms 40 that will be moved into position for driving engagement with each sheet 15.

Figure 3:
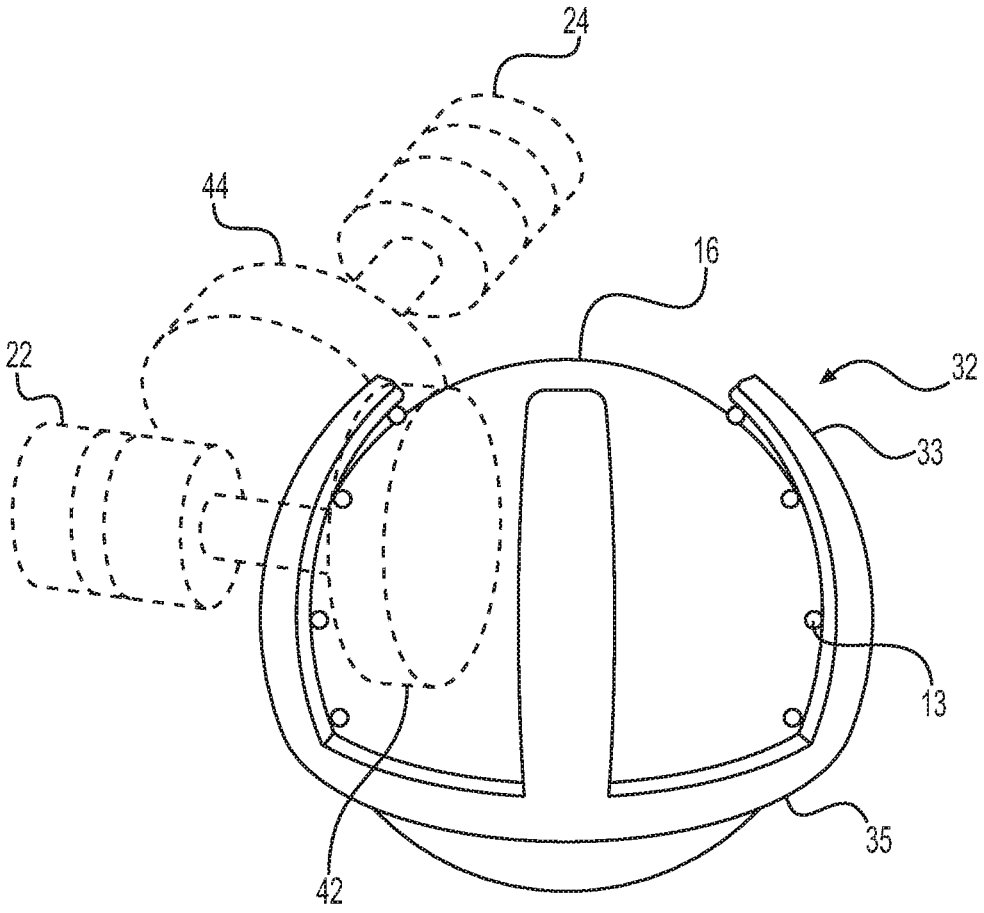
FIG. 3 is a perspective view of an exemplary embodiment of a gripper ball held by a fixture for use in a sheet orienting system consistent with an embodiment of this disclosure.

An exemplary embodiment of fixture 32 shown in detail in FIG. 3 may include a central annular portion 35 configured to extend around gripper ball 16 along a central median portion of the ball, and a plurality of conforming arms 33 that may extend upwardly from the central annular portion in radial planes and following the outer profile of the ball. Central annular portion 35 and arms 33 of fixture 32 may be configured to capture and rotatably support gripper ball 16 such that it can be rotated by drive disks 42 and 44. Other alternative configurations of fixture 32 may include a support plate with spherical cutouts designed to rotatably support each of a plurality of gripper balls such that a bottom portion of each gripper ball extends past the bottom surface of the plate.

A plurality of small roller bearings 13 may be included as part of fixture 32 and located between inner arcuate surfaces of central annular portion 35 and arms 33 of fixture 32 and the outer peripheral surface of gripper ball 16 to ensure a nearly frictionless interface between the fixture and the gripper ball. Alternative configurations of fixture 32 may include providing inner surfaces of fixture 32 with anti-friction coatings designed to enhance lubricity and frictionless rotation of gripper ball 16 in fixture 32 in spite of characteristics of the outer peripheral surface of gripper ball 16 designed to enhance frictional engagement with a sheet of material such as paper.

In one exemplary embodiment of fixture 32, conforming arms 33 may be configured to flex enough to allow gripper ball 16 to be pressed downwardly into fixture 32 during installation, with the ends of the conforming arms flexing outwardly to provide clearance for the outer diameter of gripper ball 16 as gripper ball 16 is installed into fixture 32. Central annular portion 35 of fixture 32 may be configured with an arcuate inner profile that fits around a central median circumferential portion of gripper ball, extending slightly above and below an equatorial median plane of gripper ball 16 and rotatably capturing gripper ball 16 when it is pressed into fixture 32. The spacing between conforming arms 33 exposes outer peripheral portions of gripper ball 16 such that first drive disk 42 may contact a first outer peripheral portion of gripper ball 16 at a position approximately 90 degrees from a second outer peripheral portion of gripper ball 16 contacted by second drive disk 44.

Drive disks 42 and 44 may exert a radially inward and downward pressure against the outer peripheral surface of gripper ball 16 above the equatorial median plane of gripper ball 16, pressing gripper ball 16 downward against central annular portion 35 and helping to retain gripper ball 16 in fixture 32 as each sheet drive mechanism 40 exerts a frictional driving force against sheet 15. In other alternative embodiments, such as when a fixture for rotatably supporting gripper balls 16 includes a plate or other structural support member with spherical cutouts for supporting each gripper ball 16, one or more rotatable drive disks may be positioned such that side surfaces of the one or more rotatable drive disks engage with top portions of each gripper ball 16, thus causing gripper ball 16 to rotate about the Z axis perpendicular to sheet 15. An advantage of providing two drive disks that drivingly engage with each gripper ball at two, 90 degree spaced locations, such as shown in FIGS. 1 and 2, is that relatively small changes in the rotational speeds of each drive disk, and differentials between the rotational speeds of each drive disk result in significant changes in the direction of rotation of gripper ball 16.

Figure 4:
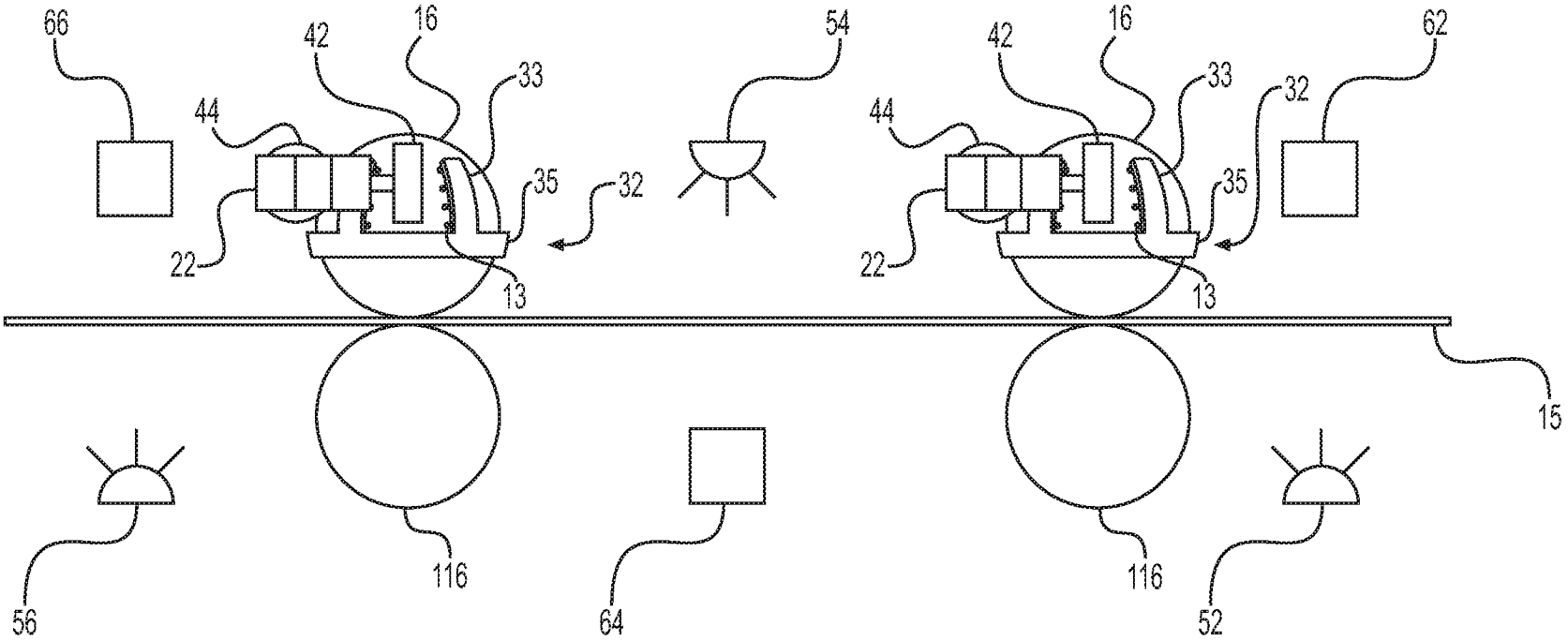
FIG. 4 is a schematic illustration providing a side elevation view of the exemplary sheet orienting system of FIG. 1.

The orientation of the axis of rotation of gripper ball 16 and speed of rotation of gripper ball 16 depend on the relative sizes and speeds of drive disks 42 and 44, which drive gripper ball 16. For example, if drive disk 42 is kept at zero velocity while drive disk 44 rotates, the axis of rotation of gripper ball 16 will be parallel to the axis of drive disk 44, and the speed of rotation will be proportional to the speed of rotation of drive disk 44. Each drive disk 42, 44 may be oriented with its central axis of rotation parallel to the plane of sheet 15, and with the disk positioned to contact the outer peripheral surface of gripper ball 16 as close as possible to a vertical plane that passes through the center of gripper ball 16, as best seen in FIG. 4. This ensures that the axis of rotation of gripper ball 16 will remain parallel to the plane of sheet 15, which is the plane in which any changes to sheet orientation will occur. Maintaining the axis of rotation of gripper ball 16 parallel to the plane of sheet 15 also enables transfer of the rotational motion of each drive disk to gripper ball 16, and from gripper ball 16 to translational motion of sheet 15 as effectively and efficiently as possible with the smallest possible amount of rotation of the drive disks and power drawn by the motors to achieve a desired reorientation of sheet 15.

If both drive disks 42 and 44 are driven at the same velocity, the axis of rotation of gripper ball 16 will be substantially perpendicular to the sheet path 80, or in the direction of the X-axis shown in FIG. 2. Thus, the velocity (i.e. magnitude and direction) of the nip at the point of engagement between gripper ball 16 and sheet 15 may be controlled by controlling the speed of rotation of motors 22, 24 and drive disks 42 and 44. Selectively differentially actuating motors 22, 24 that rotate drive disks 42, 44 of each sheet drive mechanism 40 spaced transversely across sheet path 80 causes a change in the orientation of the axis of rotation of gripper ball 16, and hence a change in resulting orientation of sheet 15. Moreover, selectively differentially actuating motors 22, 24 of one sheet drive mechanism 40 on one transverse side of sheet 15 relative to the motors for another sheet drive mechanism at a different transverse location along sheet 15 may cause a change in orientation and position of sheet 15.

As shown in FIG. 4, each gripper ball 16 and corresponding backer ball 116 may form a nip with each sheet 15. As discussed above, a magnetic force may be employed to bias each drive disk 42, 44 into engagement with gripper ball 16, and a vertical component of the engagement force between each drive disk and gripper ball may contribute to a downward force of gripper ball 16 against sheet 15. In some embodiments fixture 32 may be supported with a bias in a downward direction in order to create the desired nip between gripper ball 16, sheet 15, and a support surface such as backer ball 116. Alternative implementations may include mounting each electric motor 22 and 24 such that the motors and drive disks are biased by springs or other biasing members into engagement with gripper ball 16. Such a biased engagement between the drive disks and the gripper ball may automatically compensate for any wear over time, and ensure continued contact between the drive disks and gripper ball 16.

During a sheet orientation operation, it may be desired to drive sheet 15 in the direction of sheet path 80 while registering a side edge of sheet 15 to a reference line 90 parallel to sheet path 80. Sensors may be positioned along reference line 90 in order to provide feedback to controller 100 in such a scenario. In the embodiment illustrated in FIGS. 1 and 2, a plurality of LED lights 52, 54, 56 may be positioned along a line transverse to sheet path 80 and in line with a projected leading edge of a properly oriented sheet 15 introduced into the machine that includes sheet driving system 10. A plurality of corresponding light sensors 62, 64, 66 may be positioned to face each of the LED lights, with sheet 15 passing in between LED lights 52, 54, 56 and light sensors 62, 64, 66. The pairs of lights and light sensors provide feedback to controller 100 based on the orientation of sheet 15 and the time when the path of light between each pair is interrupted by a portion of sheet 15 traveling along sheet path 80.

In some implementations a row of the LED lights may be located below sheet path 80 and the corresponding light sensors may be located above sheet path 80. In other alternative implementations, such as shown in the embodiment of FIG. 1, some of the LED lights may be located below the path followed by each sheet 15, and some LED lights may be located above the path followed by each sheet 15, with corresponding light sensors positioned on the opposite sides of the path. This configuration ensures that a forward leading edge of each sheet 15 will be detected by the light sensors as the path of light from an LED light to a light sensor is broken by the edge of sheet 15. Alternative embodiments may include other types of proximity detectors for sensing the arrival of different portions of a sheet as it travels along sheet path 80.

As shown in the inset of FIG. 1, a sheet 15 introduced into the machine including sheet driving system 10 may be skewed relative to sheet path 80. There are various feedback control strategies that may be implemented by controller 100 in order to operate sheet drive mechanisms 40 and selectively reorient sheet 15 to be aligned in the direction of sheet path 80 with each side edge of sheet 15 substantially parallel to reference line 90 shown in FIG. 2.

One exemplary feedback control strategy is now described: Before sheet 15 enters the nips formed between each gripper ball 16 and corresponding sheet support member, such as a backer ball 116 shown in FIG. 4, each gripper ball 16 may be driven by first drive disk 42 and second drive disk 44 to rotate about an axis of rotation substantially perpendicular to the direction of sheet path 80 at a nominal process speed. Reference to "substantially perpendicular," "approximately 90 degree angular spacing," and other similar terms of degree throughout this application refers to values that fall within ranges defined by normal machining and assembly tolerances. When each gripper ball 16 is rotating about an axis of rotation substantially perpendicular to the direction of sheet path 80, there is essentially no component of nip velocity in the transverse direction perpendicular to sheet path 80.

Referring to an embodiment shown in FIG. 2, command signals from control system 100 to motors 22, 24 of each of sheet drive mechanisms 40, causing rotation of each of drive disks 42, 44 at the same rotational speeds will result in each gripper ball 16 rotating about an axis of rotation substantially perpendicular to the direction of sheet path 80 and driving sheet 15 in the direction of sheet path 80. The direction of rotation of each drive disk will also determine which direction gripper ball 16 rotates, and hence which direction sheet 15 is driven by each gripper ball 16. Command signals from control system 100 that cause a differential between the rotation speeds of drive disks 42, 44 for each gripper ball 16 result in a change in the orientation of the axis about which gripper ball 16 rotates. Various alternative embodiments may include positioning drive disks 42, 44 to contact the outer peripheral surface of gripper ball 16 at different angular spacings from the approximately 90 degree angular spacing shown in the embodiment of FIGS. 1 and 2, and the relative rotation speeds of each drive disk may be controlled to achieve a desired orientation of the axis of rotation and speed of rotation of the associated gripper ball.

In one exemplary implementation, sheet 15 may enter the nip between gripper ball 16 and a corresponding support member, and may be sensed when a leading edge of sheet 15 passes between a first pair of a LED light 52 and a light sensor 62 on one transverse side of a leading edge of sheet 15. Each gripper ball 16 of each sheet drive mechanism 40 may be positioned transversely to sheet path 80 and offset a short distance from a line along which the sensors are positioned such that at least a portion of the leading edge of sheet 15 is sensed shortly after having been engaged by a gripper ball 16. When sheet 15 is skewed relative to the direction of sheet path 80, the opposite transverse side of sheet 15 may lag behind in the direction of sheet path 80, and may therefore not yet interrupt the path of light between a second pair of a LED light 56 and a light sensor 66 on an opposite transverse side of sheet 15. In this case light sensors 62 and 66 would provide signals to controller 100 indicative of an error in the alignment of sheet 15 relative to reference line 90, indicating that sheet 15 is skewed relative to sheet path 80.

Controller 100 may be configured to process signals received from the various sensors, with the signals being indicative of the orientation of sheet 15, and generate command signals to be sent to motors 22 and 24. Motors 22 and 24 for a sheet drive mechanism 40 on the transverse side of sheet 15 that has been detected by the pair of LED light 52 and light sensor 62 may receive command signals from controller 100 to change the speed of rotation of respective drive disks 42, 44. In one exemplary implementation of a feedback control strategy implemented by controller 100, the rotation speeds of drive disks 42, 44 may be initially slowed equally such that movement of the leading transverse side of sheet 15 caused by gripper ball 16 is slowed. Subsequently, to remove the reported error in orientation of sheet 15, or "skew error", the rotation speed of one of the drive disks driving gripper ball 16 in contact with sheet 15 may be changed relative to the rotation speed of the other drive disk driving gripper ball 16 to change the orientation of the axis of rotation of gripper ball 16, thereby introducing a transverse velocity component to the motion of the leading edge of sheet 15. In some implementations, additional sensors such as charge coupled devices (CCD's) positioned along sides of the path of travel for sheet 15 may be configured to sense edges of sheet 15 and provide additional input to controller 100 on the orientation of sheet 15.

In an exemplary embodiment, as soon as the leading edge of sheet 15 intersects the path of light between a second, transversely spaced pair of a LED light and corresponding light sensor positioned along path 80, input from both pairs of lights and light sensors to controller 100 confirms the amount of skew error for sheet 15. Inclusion of additional pairs of LED lights and light sensors across path 80 may provide an increased level of accuracy and responsiveness of sheet drive mechanisms 40 in reorienting and deskewing each sheet 15 moving along path 80. The additional, more closely spaced sensors may provide more accurate information on any time differential between sensing of different points along the leading edge of sheet 15.

Controller 100 may be further configured to process the skew error and output updated command control signals to motors 22, 24 of each of sheet drive mechanisms 40 with gripper balls 16 currently in contact with sheet 15. Controller 100 may be configured to determine updated command control signals that change the relative rotation speeds of drive disks 42, 44 for one or more gripper balls 16 of sheet drive mechanisms 40 such that the orientations of the axes of rotation and speeds of rotation of the one or more gripper balls 16 are changed to rotate sheet 15 and counteract the detected skew error for sheet 15.

The detected skew error may also be processed by a Proportional-Integral-Derivative (PID) control module of controller 100. The PID control module may ensure that each update to a skew error value that is the difference between a desired orientation of sheet 15 and a detected orientation applies a correction based on proportional, integral, and derivative terms. The PID control module of controller 100 attempts to minimize the skew error over time by adjustment of the speeds of rotation of drive disks 42, 44 to new values determined by a weighted sum of the control terms. The P term is proportional to a current value of a skew error, the I term accounts for past values of the skew error and integrates them over time, and the D term is a best estimate of the future trend in the skew error based on its current rate of change of the skew error. The balance of these effects of the PID control module may be effective in producing optimal control of the orientation of sheet 15 without overcompensating as sheet 15 moves along sheet path 80.

In various implementations of a sheet orientation process according to this disclosure, a transverse directional component of gripper ball rotational velocity may be small compared to a component of velocity in the direction of sheet path 80. Therefore, as shown in FIG. 2, motors 22, 24 and drive disks 42, 44 of each sheet drive mechanism 40 may be oriented such that each of drive disks 42, 44 drives gripper ball 16 at 45 degrees to the direction of sheet path 80. This arrangement allows motors 22, 24 to be driven at near constant velocity with small velocity variations required for achieving changes in the orientation of the axis of rotation of gripper ball 16 and deskewing of sheet 15 as described above. Alternative implementations of sheet orienting system 10 may include different motor locations and orientations of the axes of rotation of the drive disks.

The constant feedback provided to controller 100 by the pairs of lights and light sensors, with or without additional sensor feedback provided by CCD's along sides of sheet path 80, enables a closed loop control implemented by controller 100 to self-compensate for wear of drive disks 42, 44 and gripper ball 16. The biasing features discussed above for maintaining contact between the drive disks and the gripper ball ensure that any wear does not cause the drive disks and gripper balls to lose contact during sheet driving and deskewing operations, and the constant feedback control system automatically adjusts for wear. Thus, the components of sheet drive mechanisms 40 last until they are completely worn without any degradation in performance.

The arrangement of sheet drive mechanisms 40 with gripper balls 16 rotatably supported in fixtures 32, as discussed above, enables the sheet driving system according to embodiments of this disclosure to fit within a relatively short distance along sheet path 80 while achieving changes to sheet position with a minimal amount of rotation of drive disks. Additionally, the closed loop system of sensors, controller, and motor driven drive disks described above avoids potential problems and loss of accuracy over time resulting from worn components.

A person skilled in the art will appreciate that multiple options and modifications exist to the disclosed methods and apparatus. It will be appreciated that the disclosed methods and apparatus are not limited to the particular configurations of the disclosed exemplary embodiments.

The elements in the claims are to be interpreted broadly based on the language employed in the claims and not limited to examples described in the present specification or during the prosecution of the application, which examples are to be construed as non-exclusive. It is intended, therefore, that the specification and examples be considered as exemplary only, with a true scope and spirit being indicated by the following claims and their full scope of equivalents.

What is claimed is:

1. An Automated Teller Machine (ATM), comprising:

a sheet driving system, wherein the sheet driving system comprises:

a sheet path, wherein sheets travel in a direction parallel to a first direction along the sheet path;

a first sheet sensor and a second sheet sensor adjacent the sheet path, wherein the first and second sheet sensors are disposed apart from each other in a transverse direction relative to the first direction;

a first sheet drive mechanism and a second sheet drive mechanism adjacent the sheet path, wherein the second sheet drive mechanism is disposed apart from the first sheet drive mechanism in a transverse direction relative to the first direction, and wherein each sheet drive mechanism is selectively operative to change relative speed and direction of movement of disposed areas of a sheet adjacent to the sheet drive mechanisms as the sheet travels adjacent to the sheet drive mechanisms along the sheet path; and a control system in operative connection with the first and second sheet sensors and the first and second sheet drive mechanisms, wherein the control system is operative responsive to sensing a sheet with at least one of the first or second sensors to selectively actuate at least one of the first or second sheet drive mechanisms to change the position of the sheet relative to the sheet path, wherein each of the sheet drive mechanisms comprises:

two motors;

two drive disks, each of the drive disks being rotatably driven by one of the motors;

a fixture; and a ball rotatably supported in the fixture with portions of the outer peripheral surface of the ball being exposed through openings in the fixture and frictionally engaged with the drive disks.

2. The ATM of claim 1, wherein the motors are electrical motors configured to receive drive signals from the control system to change the speed of rotation of the two drive disks upon the selective actuation of at least one of the first or second sheet drive mechanisms to change the position of the sheet relative to the sheet path.

3. The ATM of claim 2, wherein the axes of rotation of the two drive disks are oriented at approximately 90 degrees from each other, and the two drive disks contact the outer peripheral surface of the ball at positions spaced from each other by approximately 90 degrees from each other around the circumference of the ball.

4. The ATM of claim 3, wherein the central axes of the drive disks are each oriented at approximately 45 degrees from the first direction.

5. The ATM of claim 1, wherein the control system is configured to operate in a closed loop by periodically determining the amount of skew of the sheet relative to the first direction based on input from the sensors, selectively actuating at least one of the sheet drive mechanisms to eliminate the determined amount of skew, and repeating the process of determining and eliminating the amount of skew based on real time feedback received by the control system from the sensors.

6. An apparatus for driving one or more sheets, the apparatus comprising:

a sheet path, wherein sheets travel in a direction parallel to a first direction along the sheet path;

a first sheet sensor and a second sheet sensor adjacent the sheet path, wherein the first and second sheet sensors are disposed apart from each other in a transverse direction relative to the first direction;

a first sheet drive mechanism and a second sheet drive mechanism adjacent the sheet path, wherein the second sheet drive mechanism is disposed apart from the first sheet drive mechanism in a transverse direction relative to the first direction, and wherein each sheet drive mechanism is selectively operative to change relative speed and direction of movement of disposed areas of a sheet adjacent to the sheet drive mechanisms as the sheet travels adjacent to the sheet drive mechanisms along the sheet path; and a control system in operative connection with the first and second sheet sensors and the first and second sheet drive mechanisms, wherein the control system is operative responsive to sensing a sheet with at least one of the first or second sensors to selectively actuate at least one of the first or second sheet drive mechanisms to change the position of the sheet relative to the sheet path, wherein each of the sheet drive mechanisms comprises:

two motors;

two drive disks, each of the drive disks being rotatably driven by one of the motors;

a fixture; and a ball rotatably supported in the fixture with portions of the outer peripheral surface of the ball being exposed through openings in the fixture and frictionally engaged with the drive disks.

7. The apparatus of claim 6, wherein the fixture includes a central annular portion rotatably supporting the ball around a central equatorial region of the ball, and a plurality of conforming arms extending upward from the central annular portion part way along the outer peripheral surface of the ball for retaining the ball in the fixture.

8. The apparatus of claim 6, wherein the drive disks are frictionally engaged with the outer peripheral surface of the ball at locations spaced approximately 90 degrees from each other around the outer circumference of the ball.

9. The apparatus of claim 6, wherein the central axes of the drive disks are oriented at approximately 90 degrees from each other.

10. The apparatus of claim 6, wherein the motors are electrical motors configured to receive drive signals from the control system to change the speed of rotation of the two drive disks upon the selective actuation of at least one of the first or second sheet drive mechanisms to change the position of the sheet relative to the sheet path.

11. The apparatus of claim 6, wherein the central axes of the drive disks are each oriented at approximately 45 degrees from the first direction.

12. The apparatus of claim 6, wherein the first and second sheet sensors each comprise a pair of a light source and a light detector positioned on opposite sides of the sheet path.

13. The apparatus of claim 6, wherein the control system is operative responsive to sensing a sheet with at least one of the first or second sensors to selectively actuate only one of the first and second sheet drive mechanisms with a disposed area of the sheet adjacent to the one sheet drive mechanism to change the position of the sheet relative to the sheet path.

14. The apparatus of claim 6, wherein the control system is operative responsive to sensing a sheet with the first and second sensors to determine an amount of skew of the sheet relative to the first direction based on a difference in time between when the first and second sensors each first detect a leading edge of the sheet, and to selectively actuate the first and second sheet drive mechanisms differentially based on the amount of skew to change the orientation of the sheet relative to the first direction to eliminate the amount of skew.

15. The apparatus of claim 14, wherein the control system is configured to operate in a closed loop by periodically determining the amount of skew of the sheet relative to the first direction based on input from the sensors, selectively actuating the sheet drive mechanisms to eliminate the determined amount of skew, and repeating the process of determining and eliminating the amount of skew based on real time feedback received by the control system from the sensors.

16. The apparatus of claim 14, wherein the control system comprises a Proportional-Integral-Derivative (PID) control module configured to update a skew error value that is the difference between a desired orientation of the sheet and a detected orientation of the sheet by selectively actuating the first and second sheet drive mechanisms based on one or more of a term proportional to a current value of a skew error, an integral term that accounts for past values of the skew error and integrates them over time, and a derivative term that is a best estimate of a future trend in the skew error based on a current rate of change of the skew error.

17. The apparatus of claim 14, wherein the control system is configured to selectively actuate the first and second sheet drive mechanisms differentially by changing the speed of rotation of the two drive disks for at least one of the sheet drive mechanisms upon the selective actuation of at least one of the first or second sheet drive mechanisms to change the position of the sheet relative to the sheet path.

18. A machine control system for a machine comprising:

a sheet path, wherein sheets travel through a portion of the machine in a direction parallel to a first direction along the sheet path;

a first sheet sensor and a second sheet sensor adjacent the sheet path, wherein the first and second sheet sensors are disposed apart from each other in a transverse direction relative to the first direction; and a first sheet drive mechanism and a second sheet drive mechanism adjacent the sheet path, wherein the second sheet drive mechanism is disposed apart from the first sheet drive mechanism in a transverse direction relative to the first direction, and wherein each sheet drive mechanism is selectively operative to change relative speed and direction of movement of disposed areas of a sheet adjacent to the sheet drive mechanisms as the sheet travels adjacent to the sheet drive mechanisms along the sheet path, and wherein each of the sheet drive mechanisms includes:

two motors;

two drive disks, each of the drive disks being rotatably driven by one of the motors;

a fixture; and a ball rotatably supported in the fixture with portions of the outer peripheral surface of the ball being exposed through openings in the fixture and frictionally engaged with the drive disks;

the machine control system being configured to:

receive signals from the first and second sheet sensors indicative of a skew in an orientation of the sheet relative to the first direction; and send command signals to the first and second sheet drive mechanisms to selectively actuate the first and second sheet drive mechanisms to change the position of the sheet relative to the sheet path.

* * * * *